US005108222A

United States Patent [19]

Jansson et al.

[11] Patent Number: 5,108,222

[45] Date of Patent: Apr. 28, 1992

[54] ARTICULATED, PREDOMINANTLY CONCRETE MAT

[76] Inventors: Jan E. Jansson, 814 S. Sierra Ave., Solana Beach, Calif. 92075; James F. Fish, P.O. Box 441, Rancho Santa Fe, Calif. 92067

[21] Appl. No.: 581,480

[22] Filed: Sep. 11, 1990

[51] Int. Cl.[5] ..... E02B 3/12

[52] U.S. Cl. ..... 405/20; 405/15

[58] Field of Search ..... 405/15-20, 405/258

[56] References Cited

U.S. PATENT DOCUMENTS

| | | | |
|---|---|---|---|
| 3,597,928 | 8/1971 | Pilaar | 405/20 |
| 4,152,875 | 5/1979 | Soland | 405/19 X |
| 4,227,829 | 10/1980 | Landry | 405/20 |
| 4,370,075 | 1/1983 | Scales | 405/20 |
| 4,375,928 | 3/1983 | Crow et al. | 405/20 |
| 4,664,552 | 5/1987 | Schaaf | 405/20 |
| 4,683,156 | 7/1987 | Waters | 405/20 X |

FOREIGN PATENT DOCUMENTS

| | | | |
|---|---|---|---|
| 59044 | 12/1967 | German Democratic Rep. | 405/20 |
| 2139676 | 11/1984 | United Kingdom | 405/20 |
| 2168738 | 6/1986 | United Kingdom | 405/17 |

*Primary Examiner*—Randolph A. Reese
*Assistant Examiner*—John Ricci
*Attorney, Agent, or Firm*—Dressler, Goldsmith, Shore, Sutker & Milnamow, Ltd.

[57] ABSTRACT

An articulated, predominantly concrete mat. Discrete, concrete blocks conforming generally to rectangular solids are arranged in a grid, preferably a rectangular grid. A geogrid of a type capable of being handled in one piece by itself is embedded in each block. In a preferred form, the geogrid is a flexible, one-piece sheet of oriented, polymeric material. In an alternative form, the geogrid is a weave of flexible, discrete straps of oriented, polymeric material that are joined where they intersect. Each block has a hole extending therethrough and communicating with an aperture of the geogrid.

7 Claims, 1 Drawing Sheet

ARTICULATED, PREDOMINANTLY CONCRETE MAT

TECHNICAL FIELD OF THE INVENTION

This invention pertains to an articulated, predominantly concrete mat comprising a geogrid and discrete, concrete castings, which preferably are arranged in a grid. According to this invention, the geogrid is embedded in each casting.

BACKGROUND OF THE INVENTION

Articulated, predominantly concrete mats have numerous uses in retarding earth erosion due to wind, water, or both. Such mats are used in diverse applications as on shorelines, on river beds, at earthen dams, slopes, trenches and elsewhere, such as where revetments are needed.

Typically, such a mat comprises discrete, concrete blocks arranged in a rectangular grid, in which the concrete blocks are joined by cables, ropes, chains, or like elements. As exemplified in Scales U.S. Pat. No. 4,370,075, it is known for such concrete blocks to have holes permitting vegetation to grow therethrough.

As exemplified in Landry, Jr., U.S. Pat. No. 4,227,829, Schaaf U.S. Pat. No. 4,664,552, and Waters U.S. Pat. No. 4,683,156, and in the Scales patent noted above, it is common to join the concrete blocks by cables passing through small holes in the concrete castings, while the concrete blocks are arranged in a rectangular or hexagonal grid. It is cumbersome to pass cables through small holes in the concrete blocks, particularly if many concrete blocks are to be thus joined. Moreover, before and after such a mat has been installed, the concrete blocks tend to shift along the cables.

As exemplified in Crow et al. U.S. Pat. No. 4,375,928, it is known to join the concrete blocks by cables embedded in the concrete blocks, which are cast in forms holding cables being embedded. It is cumbersome to deploy a cable or cables in a concrete-casting form, particularly if the form is used to cast many concrete blocks simultaneously.

In Pilaar U.S. Pat. No. 3,597,928, it is disclosed that such blocks may be adhesively attached, in one layer or in two layers, to a supporting sheet of synthetic mesh. Adhesive attachment may not be entirely satisfactory, particularly if such blocks are exposed to powerful wind or water action.

There has been a need, to which this invention is addressed, for a better way to join discrete, concrete castings, such as pads, slabs, or blocks, in an articulated mat.

SUMMARY OF THE INVENTION

This invention provides an articulated mat comprising a geogrid and discrete, concrete castings, such as pads, slabs, or blocks, which preferably are arranged in a grid. Preferably, the apertures defined by the geogrid are arranged in a similar grid. The geogrid is embedded in each concrete casting of the mat. The geogrid joins the castings at sufficient distances relative to one another to permit the mat to articulate.

A geogrid is a flexible, mesh-like or net-like member, which has a substantially planar structure and is capable of being handled in one piece. Although geogrids are used widely in earth-stabilizing applications, it is believed that geogrids have not been heretofore embedded in concrete castings in an articulated mat.

Preferably, the geogrid embedded in each concrete casting is constituted by a flexible, one-piece sheet of oriented, polymeric material, such as poly(ethylene terephthalate) or polypropylene, which may be biaxially oriented. The sheet defines the apertures of the geogrid and defines straps joining the castings. Preferably, two straps defined by the sheet join adjacent castings. Each aperture is defined by a margin constituted by surrounding portions of the sheet.

Alternatively, the geogrid embedded in each concrete casting is a weave of flexible, discrete straps of oriented, polymeric material, such as poly(ethylene terephthalate) or polypropylene, which may be uniaxially oriented. The straps define the apertures of the geogrid and join the castings.

Preferably, at least two straps join adjacent castings, so that two straps join each casting to at least one of the other castings. Each aperture is defined by a margin constituted by surrounding straps. The straps include straps intersecting at nodes. It is preferred that the intersecting straps are joined to each other at the nodes before the geogrid is embedded in each casting.

Whether the geogrid is constituted by a flexible sheet defining the apertures or by a weave of discrete straps defining the apertures, if two straps join adjacent castings, it is preferred that the margin defining one of the apertures is embedded in each casting. It is preferred, moreover, that each casting has a hole extending through such casting, in a direction substantially normal to the geogrid, and communicating with the aperture defined by the margin embedded in such casting.

Each casting may conform generally to a rectangular solid, preferably a rectangular solid that is substantially square when viewed in a plan view, except that each casting has beveled edges, preferably beveled upper and lower edges around such casting.

These and other objects, features, and advantages of this invention are evident from the following description of preferred and alternate embodiments of this invention, with reference to the accompanying drawings.

DETAILED DESCRIPTION OF ILLUSTRATED EMBODIMENTS

Figure 1:
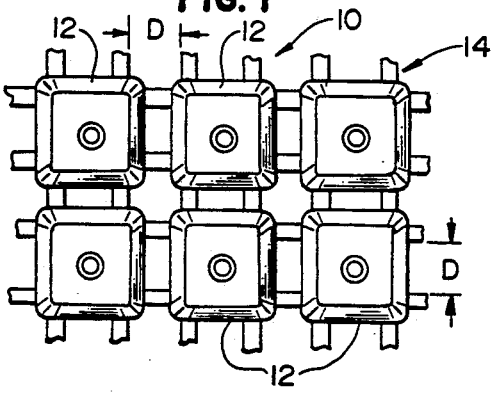
FIG. 1 is a plan view of a representative portion of an articulated, predominantly concrete mat according to a preferred embodiment of this invention.

As shown in FIG. 1, an articulated, predominantly concrete mat 10 constitutes a preferred embodiment of this invention.

The mat 10 comprises discrete, concrete blocks 12, which are arranged in a rectangular grid. Also, the mat 10 comprises a flexible geogrid 14 capable of being handled as a sheet before being embedded which is embedded in each block 12. The geogrid 14, embedded in each block 12 joins the blocks 12 in such a manner that the blocks 12 are spaced at sufficient distances relative to one another to permit the mat 10 to flex. Because the blocks 12 are arranged in a rectangular grid wherein the blocks 12 are spaced from one another, the mat 10 is permitted to flex between adjacent blocks 12, where the flexible geogrid 14 joins adjacent blocks 12.

Figure 5:
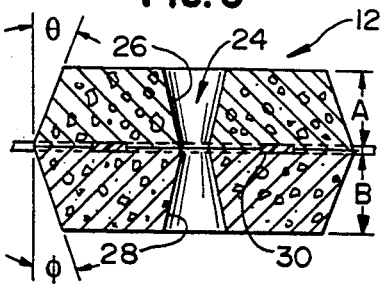
FIG. 5 is a cross-sectional view taken along plane 3—3 in FIG. 3, in a direction indicated by arrows.
Figure 3:
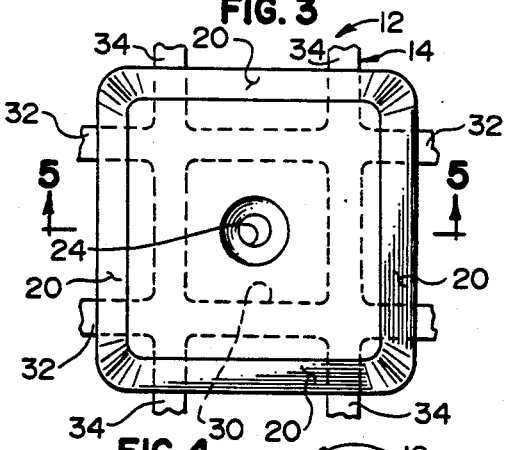
FIG. 3, on an enlarged scale, is a plan view of a concrete block representative of the concrete blocks used in the mat shown in FIG. 1. Fragmentary portions of a geogrid used with the concrete block are shown also.
Figure 4:
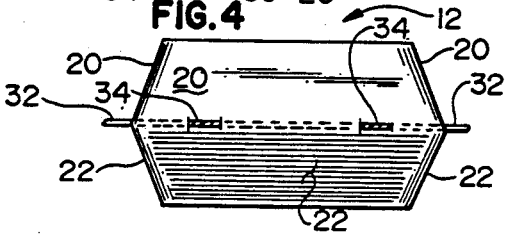
FIG. 4 is an edge view of the concrete block shown in FIG. 3, along with fragmentary portions of the geogrid used therewith.

As shown in FIGS. 3, 4, and 5, each block 12 conforms generally to a rectangular solid that is substantially square when viewed in a plan view, except that each block 12 has beveled upper edges 20 around such block 12 and beveled lower edges 22 around such block 12. The beveled edges 20, 22, permit the mat 10 to articulate even if the blocks 12 are spaced closely from one another. Preferably, each of the beveled edges 20 defines an angle $\theta$ (see FIG. 5) in a range from about 15° to about 25° relative to a vertical plane. Preferably, each of the beveled edges 22 defines an angle $\phi$ (see FIG. 5) in a range from about 10° to about 20° relative to a vertical plane. It is preferred, moreover, that the thickness A (see FIG. 5) of each block 12 above the geogrid 14 and the thickness B thereof below the geogrid 14 are selected so that $A/B \geqq 1$. It is preferred, furthermore, that the blocks 12 are spaced lengthwise and widthwise from one another by a uniform distance D (see FIG. 1) in a range from about 0.5 inch to about 1.0 inch. The distance D should be sufficient to permit articulation of the mat 10 but not so large as to permit buckling of the mat 10.

It is contemplated by this invention that concrete castings having other shapes may be substituted for the blocks or that the blocks may have other shapes. Thus, the blocks or other castings may be circular, triangular, rectangular, or hexagonal, or shaped otherwise, when viewed in plan views.

Each block 12 can have a hole 24 extending through such block 12, from an upper surface of such block 12 to a lower surface of such block 12. The hole 24 has an upper, frusto-conical surface 26 and a lower, frusto-conical surface 28. The frusto-conical surfaces 26, 28, permit such block 12 to be readily removed from a form used to cast such block 12.

Figure 6:
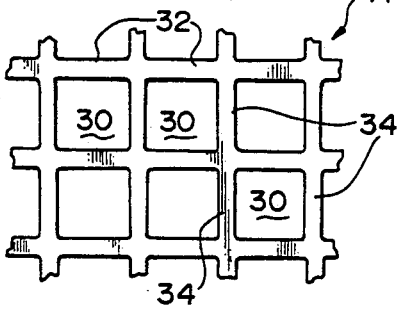
FIG. 6, on a smaller scale compared to FIGS. 3, 4, and 5, is a plan view of a representative portion of the geogrid shown in FIGS. 1, 3, and 4.

As shown in FIG. 6, the geogrid 14 is constituted by a flexible, one-piece sheet of oriented, polymeric material, such as poly(ethylene terephthalate) polypropylene and the like. The polymeric material may be biaxially oriented. A suitable geogrid constituted by such a sheet is available commercially from Tensar Corp. of Morrow, Ga., under its trade designation Tensar SS2.

The sheet constituting the geogrid 14 is perforated so as to define substantially square apertures 30, which are arranged in a rectangular grid, and so as to define straps 32 extending lengthwise along the mat 10 and straps 34 extending widthwise across the mat 10. Each aperture 30 has a margin defined by surrounding portions of the sheet constituting the geogrid 14.

Each block 12 and each of the blocks 12 nearest to such block 12 along the mat 10 are joined by two of the straps 32. Each block 12 and each of the blocks 12 nearest to such block 12 across the mat 10 are joined by at least two, preferably at least three of the straps 34. Thus, as shown in dashed lines in FIG. 3, the margin defining one of the apertures 30 is embedded within each block 12 in such manner that the hole 24 extending through such block 12 extends therethrough in a direction substantially normal to the geogrid 14 and extends through and communicates with the aperture 30 having its margin embedded in such block 12.

The holes 24 extending through the blocks 12 permit vegetation to grow through such holes 20. The apertures 30 between the blocks 12 permit vegetation to grow between the blocks 12. Vegetation growing through the holes 20 and vegetation growing between the blocks 12 tend to stabilize the mat 10 on the underlying earth and to disguise the mat 10.

Figure 7:
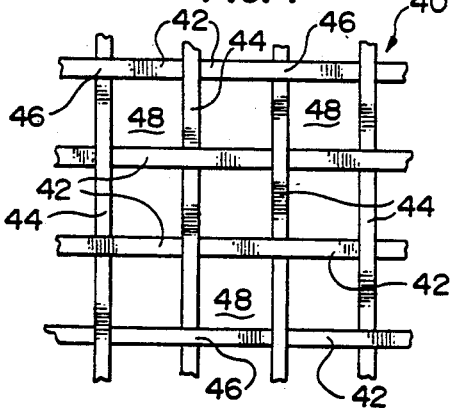
FIG. 7, on a similar scale, is a plan view of a representative portion of a geogrid that may be substituted for the geogrid shown in FIGS. 1, 3, and 4 in an alternate embodiment of this invention.

As shown in FIG. 7, a geogrid 40 that is substituted for the geogrid 14 in a mat constituting an alternate embodiment of this invention is a weave of flexible, discrete straps of oriented, polymeric material, such as poly(ethylene terephthalate) or polypropylene. Each strap may be uniaxially oriented. The straps include straps 42 extending lengthwise along the mat and straps 44 extending widthwise along the mat. The straps 42 and the straps 44 intersect at nodes 46 and define substantially square apertures 48. The apertures 48 correspond to the apertures 30 of the geogrid 14.

At each node 46, one of the straps 42 overlies or underlies one of the straps 44 and the overlying and underlying straps are joined to each other, as by friction welding. Because the overlying and underlying straps are joined to each other at each node 46, the geogrid 40 is capable of being handled as a sheet before being embedded in a plurality of discrete, concrete blocks (not shown) similar to the blocks 12 to form a mat similar, except for the geogrid 40, to the mat 10. The geogrid 40 is embedded in such blanks as the geogrid 14 is embedded in the blocks 12.

Figure 8:
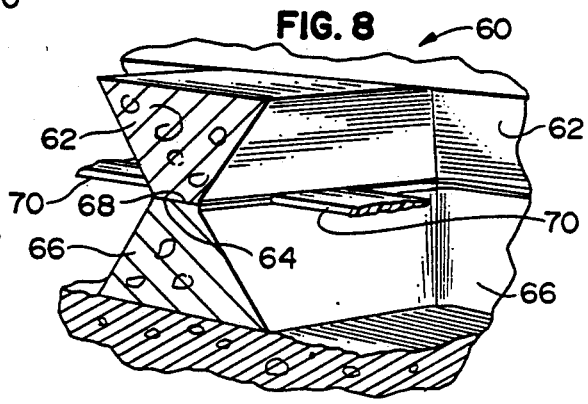
FIG. 8 is a fragmentary, perspective detail of a form useful in casting a concrete block like the concrete block shown in FIGS. 4, 5, and 6, with the geogrid embedded therein.

As shown in a closed condition in FIG. 8, a two-part form 60 of a type known for casting concrete blocks for similar uses is used to cast the concrete blocks from a conventional slurry of water, cement, and aggregate. Where each concrete block is cast, the form 60 includes an upper separator 62 having a lower surface 64 and a lower separator 66 having an upper surface 68. When the form 60 is closed, the lower surface 64 of the upper separator 62 confronts the upper surface 68 of the lower separator 66. Each of the separators 62, 66, is notched, as shown, so as to accommodate the straps of the geogrid being embedded in the concrete blocks being cast. However, in preferred embodiments the geogrid is sufficiently thin, so that a notch is not required, i.e., no more than about one-fourth inch and preferably no more than about one-eighth inch thick. One strap 70 exemplifying one of the straps 32, 34, of the geogrid 14 or one of the straps 2, 44, of the geogrid 40 is shown in FIG. 8.

Figure 2:
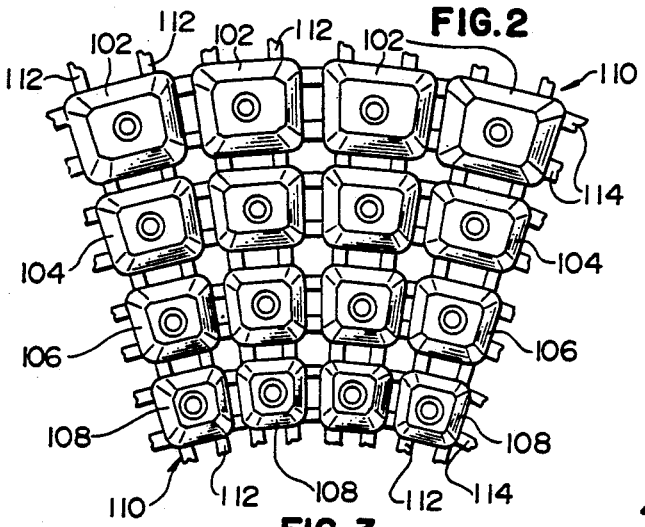
FIG. 2 is a plan view of a representative portion of such a mat according to an alternate embodiment of this invention.

As shown in FIG. 2, a mat 100 constitutes an alternative embodiment of this invention.

The mat 100 comprises discrete, concrete blocks 102, 104, 106, 108, which are similar to the concrete blocks 12, but which have trapezoidal shapes when viewed in plan views and are made in graduated sizes. The blocks 102, 104, 106, 108, are arranged in a polar grid having radial lines extending from an imaginary center (not shown) and arcuate lines intersecting the radial lines. Also, the mat 100 comprises a geogrid 110, which is similar to the geogrid 14 or to the geogrid 40, except that the geogrid 110 has straight straps 112 extending radially from the imaginary center and cambered straps 114 intersecting the straight straps 112 and following arcuate lines. The geogrid 110 is embedded in each of the blocks 102, 104, 106, 108, as the geogrid 14 is embedded in each of the blocks 12.

Various modifications may be made in the preferred and alternate embodiments described herein without departing from the scope and spirit of this invention.

We claim:

1. An articulated, predominantly concrete mat comprising a flexible, one-piece geogrid constituted by a sheet of oriented, polymeric material and discrete, concrete castings integral therewith, the geogrid being embedded in each casting, the castings being spaced relative to one another at a distance permitting articulation of the mat, the geogrid having a substantially planar structure independent of the castings and defining apertures, through which portions of the castings extend so as to embed the geogrid in the castings, the sheet defining the apertures and defining straps joining the castings.

2. The articulated mat of claim 1 wherein at least two straps join adjacent castings.

3. The articulated mat of claim 2 wherein each aperture is defined by a margin constituted by surrounding portions of the sheet, and wherein the margin of one of the apertures defined by the sheet is embedded in each casting.

4. The articulated mat of claim 3 wherein each casting has a hole extending through said casting, in a direction substantially normal to the geogrid, and through the aperture having the margin embedded in said casting.

5. The articulated mat of claim 1 wherein the grid is rectangular and wherein each casting conforms generally to a rectangular solid except that each casting has beveled edges.

6. The articulated mat of claim 5 wherein each casting conforms generally to a rectangular solid that is square when viewed in a plan view except that each casting has beveled upper and lower edges around said casting.

7. The articulated mat of claim 6 wherein each solid has a hole extending through said solid, in a direction substantially normal to the geogrid, and communicating with one of the apertures in the geogrid.

* * * * *